US009199363B2

(12) United States Patent
Chen

(10) Patent No.: US 9,199,363 B2
(45) Date of Patent: Dec. 1, 2015

(54) WRENCH DEVICE

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 389 days.

(21) Appl. No.: 13/769,841

(22) Filed: Feb. 19, 2013

(65) Prior Publication Data

US 2014/0230610 A1 Aug. 21, 2014

(51) Int. Cl.

| | |
|---|---|
| ***B25B 23/16*** | (2006.01) |
| ***B25G 1/00*** | (2006.01) |
| ***B25B 13/00*** | (2006.01) |
| ***B25B 23/00*** | (2006.01) |
| ***B25G 1/06*** | (2006.01) |
| *B25B 13/08* | (2006.01) |
| *B25B 13/46* | (2006.01) |
| *B25B 13/48* | (2006.01) |

(52) U.S. Cl.

CPC ..... *B25B 23/0007* (2013.01); *B25B 23/0028* (2013.01); *B25B 23/0042* (2013.01); *B25G 1/066* (2013.01); *B25B 13/08* (2013.01); *B25B 13/461* (2013.01); *B25B 13/481* (2013.01)

(58) Field of Classification Search

CPC ..... B25B 23/0028; B25B 23/0042; B25B 23/0007; B25G 1/063; B25G 1/066

USPC ..... 81/125.1, 177.8, 177.7, 177.85; 11/125.1, 177.8, 177.7, 177.85

See application file for complete search history.

(56) References Cited

U.S. PATENT DOCUMENTS

| | | | | |
|---|---|---|---|---|
| 5,492,040 | A * | 2/1996 | Bellas | 81/125.1 |
| 6,883,404 | B2 * | 4/2005 | Hsien | B25B 13/04 81/125.1 |
| 8,028,607 | B2 * | 10/2011 | Lee et al. | 81/60 |
| 2007/0062341 | A1 * | 3/2007 | Hsieh | 81/177.2 |
| 2008/0196559 | A1 * | 8/2008 | Allan | 81/177.85 |
| 2013/0152747 | A1 * | 6/2013 | Kerboul et al. | 81/478 |

* cited by examiner

*Primary Examiner* — Bryan R Muller

(57) ABSTRACT

A wrench device includes a first handle and a second handle. The first handle has a pivotal connecting segment and a driving head defined at two ends thereof respectively. The pivotal connecting segment has a groove defined around an outer periphery thereof. The second handle has a pivotal connecting recess and a driving part defined at two ends thereof respectively. The pivotal connecting segment of the first handle is pivotally inserted into the pivotal connecting recess of the second handle. The second handle has a side screwed hole opened on a surface therethrough. The side screwed hole communicates with the pivotal connecting recess and corresponds to the groove. A position member is screwed into the side screwed hole. Therefore, when either the driving head or the driving part is broken, the first handle and the second handle can be separated by unscrewing the position member from the side screwed hole.

2 Claims, 7 Drawing Sheets

WRENCH DEVICE

BACKGROUND OF THE INVENTION

1. Field of the Invention

The present invention relates to a wrench device, and more particularly to a wrench device which has a first handle and a second handle, wherein the first handle can axially rotate relative to the second handle.

2. Description of Related Art

Hand tools are widely used within a variety of industries, such as manufacturing, assembling or maintaining businesses. Most of the hand tools are equipped with one or two driving parts so as to provide operational specifications of one functional end or two functional ends. Among all the hand tools, the wrenches are used most commonly and frequently.

Referring to FIG. 10, a conventional wrench device has an operational specification of two functional ends. The conventional wrench device has a first handle 91 and a second handle 92. The first handle 91 and the second handle 92 are pivotally connected with each other. A C-shaped buckle 93 sleeves on one end of the first handle 91 and abuts against an inner surface of the second handle 92 for preventing the first handle 91 being separating from the second handle 92 easily. The first handle 91 has a driving head 95 defined at another end thereof. The second handle 92 has an open-end wrench 94 defined at one end thereof. The first handle 91 is rotatable relative to the second handle 92, so that a user can adjust the orientation of the driving head 95 by rotating the first handle 91 relative to the second handle 92. Therefore, the crashing of the driving head, which is caused by the surrounding objects, is prevented because of the rotatable first handle 91. However, the C-shaped buckle 93 is inconvenient and difficult to disassemble from the conventional wrench device because the C-shaped buckle 93 is positioned in the second handle 92. In addition, when either the driving head 95 or the open-end wrench 94 is broken because of the carelessness of the user, the conventional wrench device remains only an operational specification of one functional end. Under such situation, the user will discard the whole conventional wrench device and buy a new one because of the lost in the functional end. As a result, the user would need to replace the conventional wrench device frequently.

In addition, the first handle 91 and the second handle 92 are easily rotated with each other when the user is using the conventional wrench device. Therefore, the user cannot use the conventional wrench device smoothly.

Thereby, the present invention has arisen to mitigate and/or obviate the disadvantages of the conventional wrench device.

SUMMARY OF THE INVENTION

The main objective of the present invention is to provide an improved wrench device.

To achieve the objective, a wrench device comprises a first handle and a second handle, the first handle having a pivotal connecting segment defined at one end thereof, a driving head disposed at another end thereof, wherein the driving head being driven bi-directional and having two functional parts, the pivotal connecting segment having a groove defined around an outer periphery thereof, the second handle having a pivotal connecting recess defined at one end thereof, and a driving part defined at another end thereof, the pivotal connecting segment of the first handle pivotally inserted into the pivotal connecting recess of the second handle, a side screwed hole opened on a surface therethrough, the side screwed hole communicating with the pivotal connecting recess and corresponding to the groove of the first handle, a position member screwed into the side screwed hole, one end of the position member positioned in the groove of the first handle. Wherein, a sleeve slidably sleeves on the first handle, the sleeve is slidable between the first handle and a connecting portion of the first handle and the second handle, the first handle is not rotatable relative to the second handle when the sleeve is positioned at the connecting portion of the first handle and the second handle; the first handle has a first curved surface and a first limiting surface defined around an outer periphery thereof, the second handle has a second curved surface and a second limiting surface defined around an outer periphery thereof, the sleeve has an inner surface defined around therein, the inner surface of the sleeve has an inner curved surface and an inner limiting surface defined thereon, the inner curved surface of the sleeve is slidable between the first curved surface of the first handle and the second curved surface of the second handle, the inner limiting surface of the sleeve is slidable between the first limiting surface of the first handle and the second limiting surface of the second handle; the driving part of the second handle is an open-end wrench; the position member is a socket head cap screw.

Under this arrangement, when either the driving head of the first handle or the driving part of the second handle is broken, the first handle and the second handle can be separated from each other by unscrewing the position member from the side screwed hole so as to release one end of the position member from the groove of the first handle.

Further benefits and advantages of the present invention will become apparent after a careful reading of the detailed description with appropriate reference to the accompanying drawings.

DETAILED DESCRIPTION OF THE INVENTION

Figure 1:
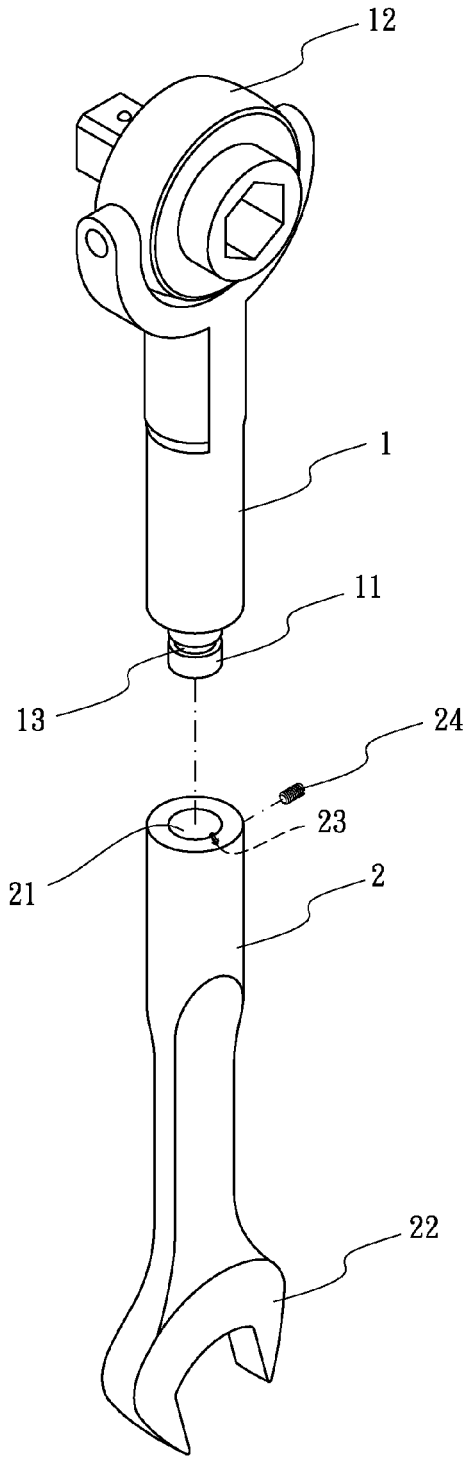
FIG. 1 is an exploded view of the present invention.
Figure 2:
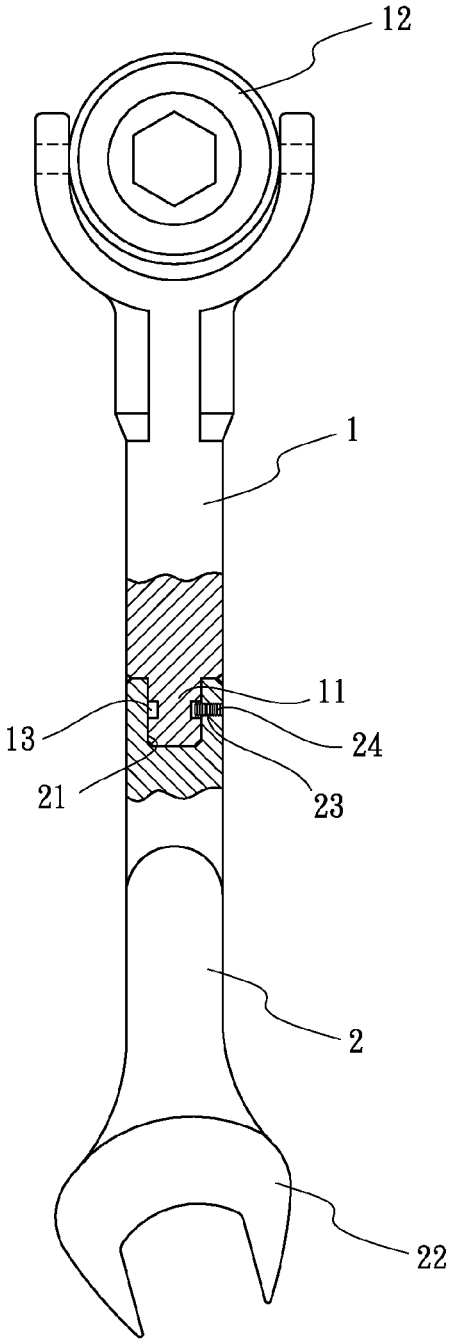
FIG. 2 is a cross-sectional view of the present invention.
Figure 3:
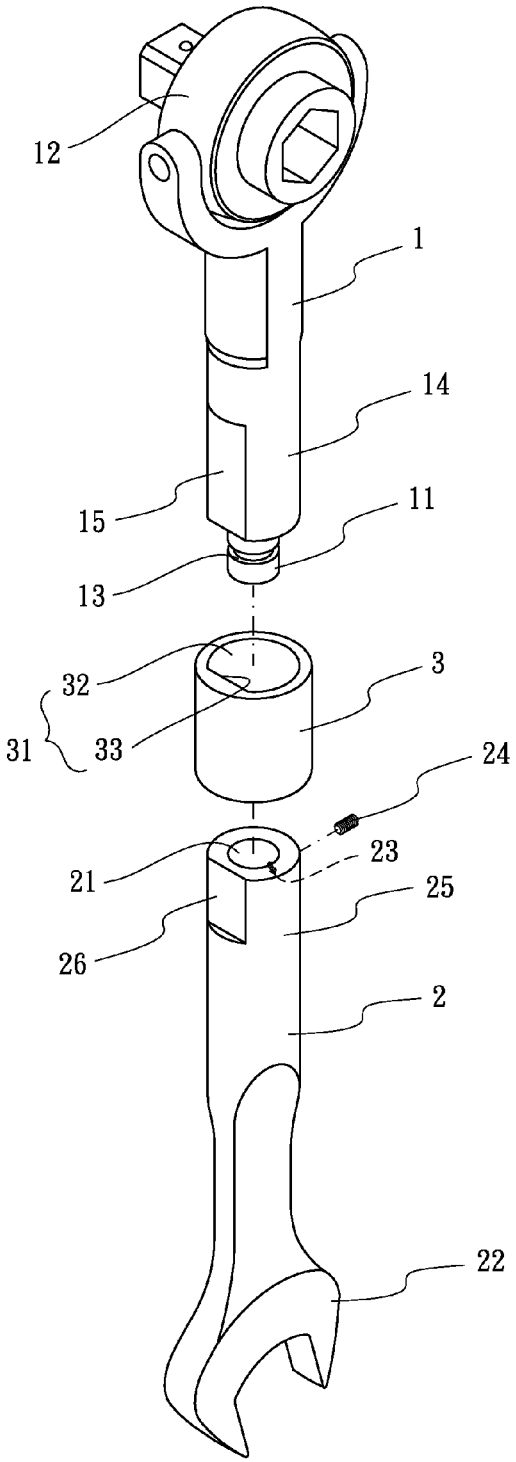
FIG. 3 is an exploded view of another embodiment of the present invention.

Referring to FIGS. 1-2, a wrench device comprises a first handle 1 and a second handle 2. The first handle 1 has a pivotal connecting segment 11 defined at one end thereof, and a driving head 12 disposed at another end thereof, wherein the driving head 12 can be driven bi-directional and has two functional parts (not numbered). The pivotal connecting segment 11 is formed as cylinder shaped and has a groove 13 defined around an outer periphery thereof. The first handle 1 has a fork-shaped portion (not numbered) defined at another end thereof, and the driving head 12 is pivotally assembled with the fork-shaped portion. The second handle 2 has a pivotal connecting recess 21 defined at one end thereof, and a driving part 22 defined at another end thereof. The pivotal connecting segment 11 of the first handle 1 is pivotally inserted into the pivotal connecting recess 21 of the second handle 2, so that the first handle 1 is axially and pivotally rotatable relative to the second handle 2. A connecting portion (not numbered) is defined at where the first handle 1 and the second handle 2 connected. The second handle 2 has a side screwed hole 23 opened on a surface therethrough. The side screwed hole 23 of the second handle 2 communicates with the pivotal connecting recess 21 of the second handle 2 and corresponds to the groove 13 of the first handle 1. A position member 24 is screwed into the side screwed hole 23 of the second handle 2. One end of the position member 24 is positioned in the groove 13 of the first handle 1. Therefore, the pivotal connecting segment 11 of the first handle 1 does not separate from the pivotal connecting recess 21 of the second handle 2 easily and the first handle lean axially rotate relative to the second handle 2 because of the position member 24. In addition, the rotation of the first handle 1 and the second handle 2 is not limited by the position member 24. Therefore, the present invention not only has the driving head 12 and the driving part 22 defined at two ends thereof respectively so as to meet the operational specification of two functional ends, but also is convenient to assemble or disassemble for a user. Even more, when either the driving head 12 of the first handle 1 or the driving part 22 of the second handle 2 is broken because of the carelessness of the user, the first handle 1 and the second handle 2 can be separated from each other by unscrewing the position member 24 from the side screwed hole 23 of the second handle 2 so as to release one end of the position member 24 from the groove 13 of the first handle 1. As a result, the user can replace only the broken first handle 1 or the broken second handle 2 with another first handle 1 or another second handle 2 so as to maintain the operational specification of two driving parts, instead of discarding the whole wrench device and buying a new wrench device. Thereby, the user does not need to replace the present invention frequently as the prior art.

In one embodiment, the driving part 22 of the second handle 2 is an open-end wrench and the position member 24 is a socket head cap screw.

In another embodiment of the present invention referring to FIGS. 3-7, a sleeve 3 slidably sleeves on the first handle 1. The sleeve 3 is slidable between the first handle 1 and the connecting portion of the first handle 1 and the second handle 2. The first handle 1 is not rotatable relative to the second handle 2 when the sleeve 3 is positioned at the connecting portion of the first handle 1 and the second handle 2, so that the user can use the present invention smoothly and conveniently.

Figure 4:
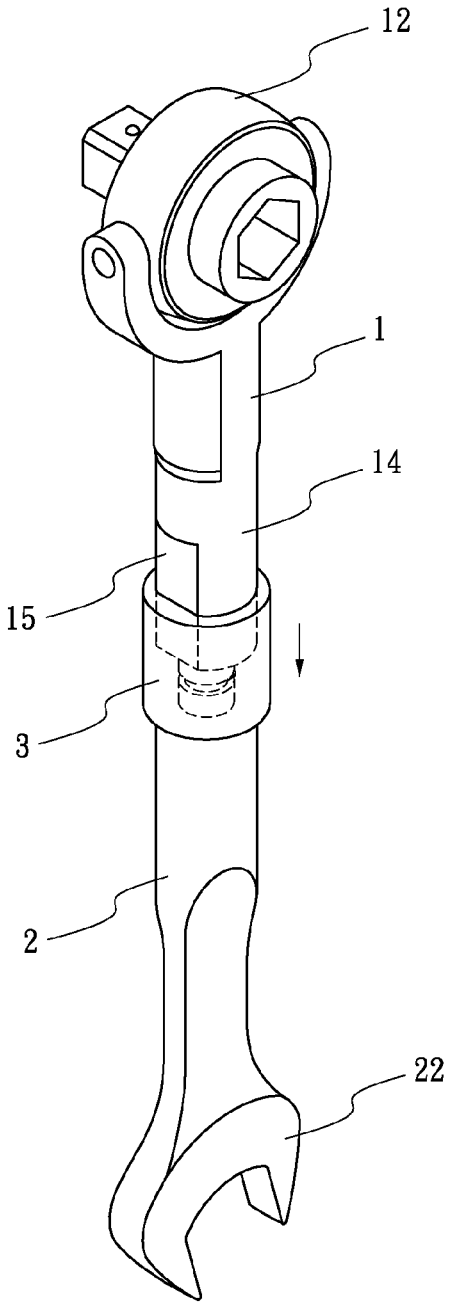
FIG. 4 is a perspective view of another embodiment of the present invention.
Figure 5:
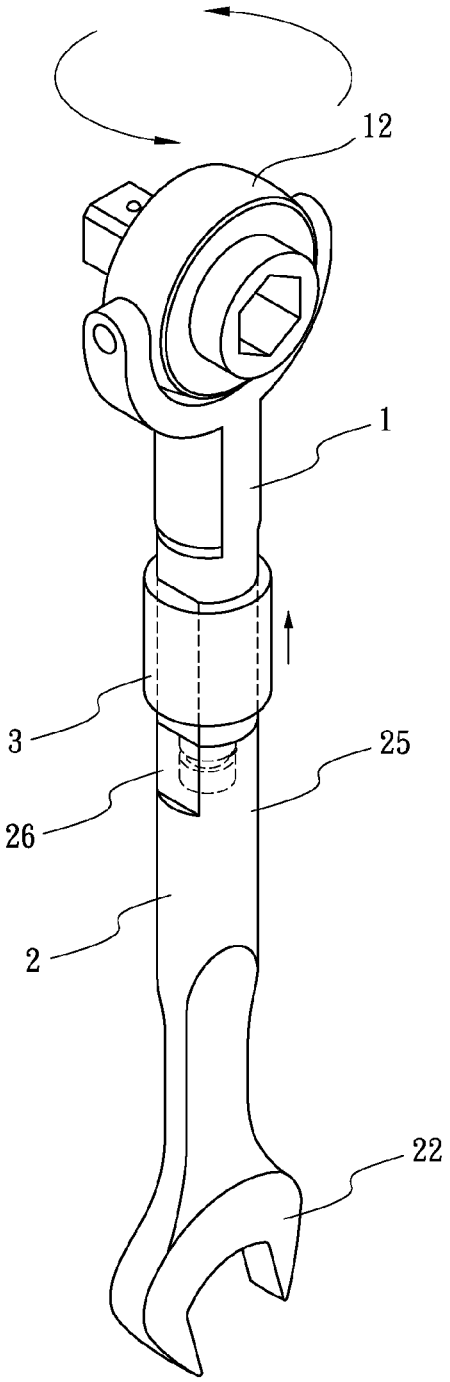
FIG. 5 is a perspective view of another embodiment of the present invention for showing a sleeve is slidable between a first limiting surface of a first handle and a second limiting surface of a second handle.
Figure 6:
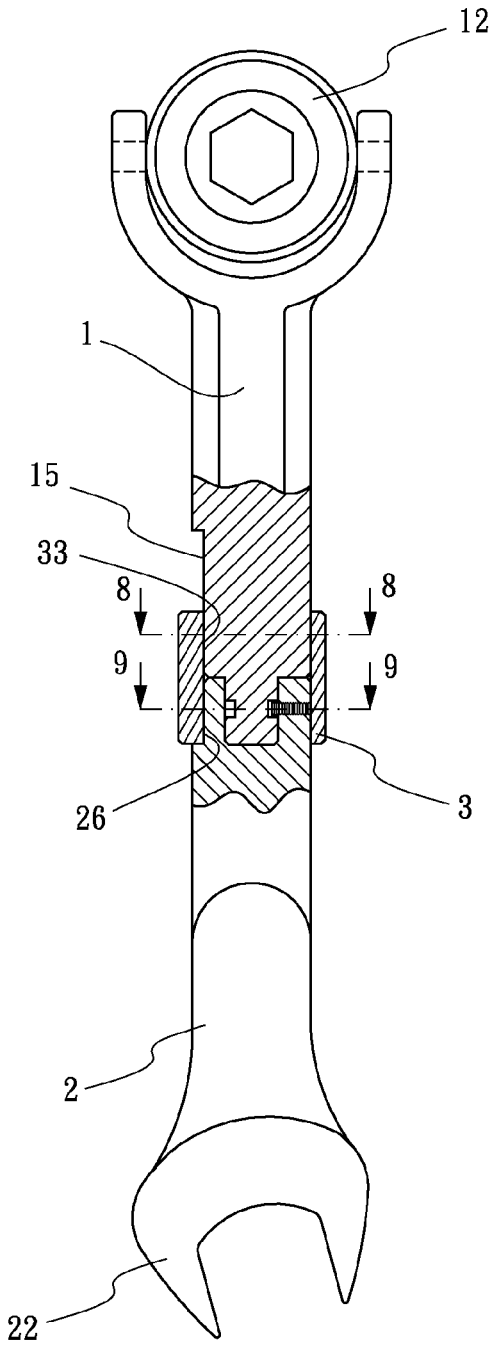
FIG. 6 is a cross-sectional view of another embodiment of the present invention for showing the sleeve is positioned at a connecting portion of the first handle and the second handle.
Figure 7:
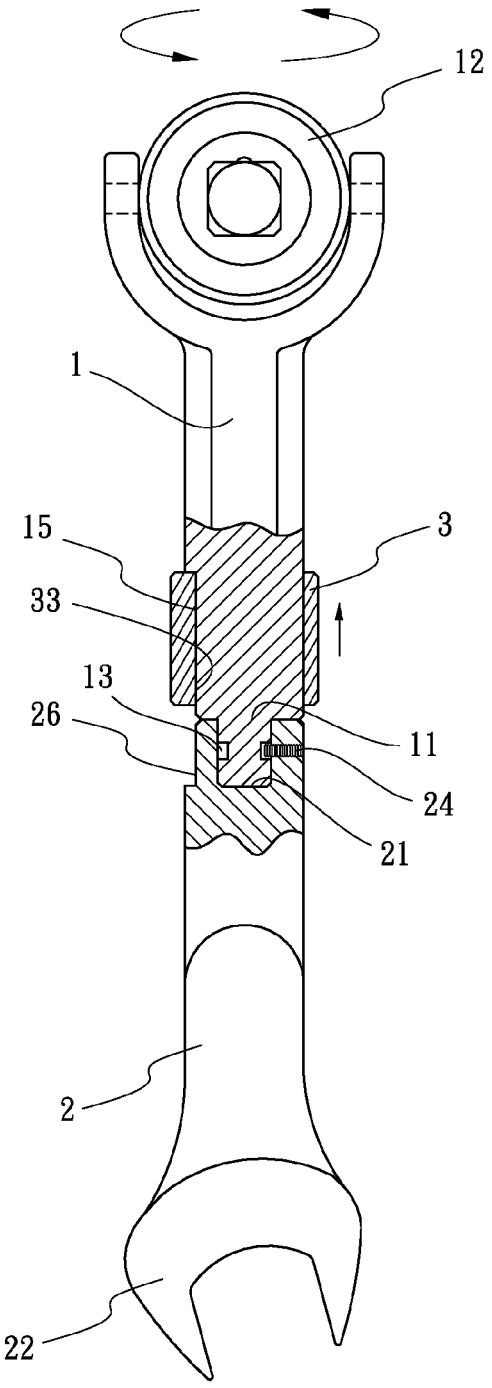
FIG. 7 is a cross-sectional view of another embodiment of the present invention for showing the sleeve is moved upwardly toward a driving head of the first handle so as to separate the sleeve from the second limiting surface of the second handle.
Figure 8:
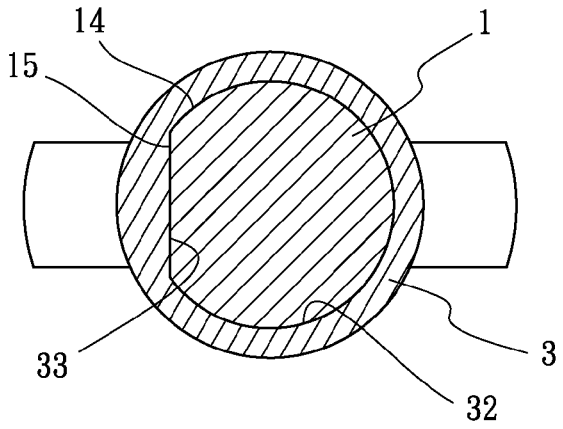
FIG. 8 is a cross-sectional view along line 8-8 as shown in FIG. 6.
Figure 9:
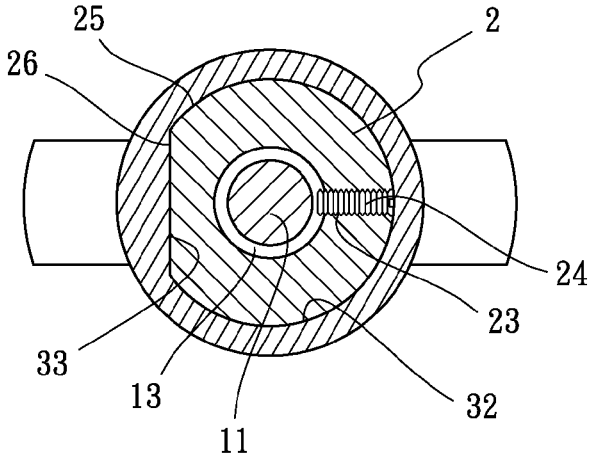
FIG. 9 is a cross-sectional view along line 9-9 as shown in FIG. 6.
Figure 10:
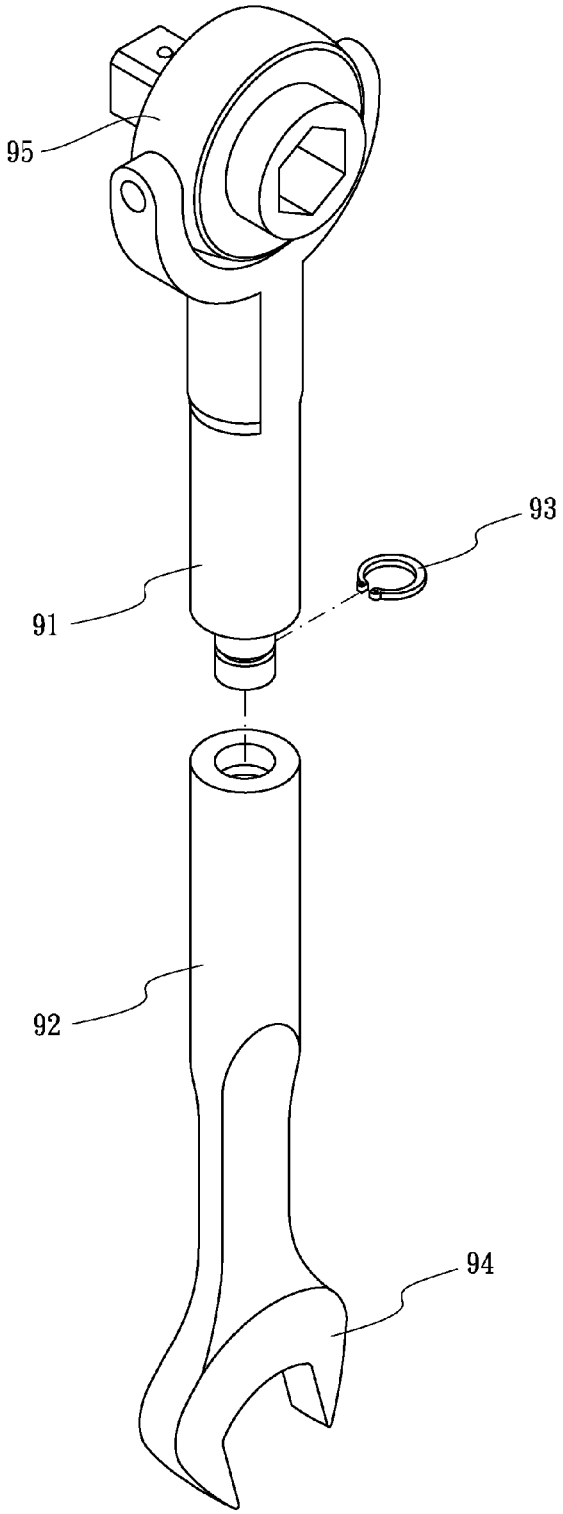
FIG. 10 (Prior art)
FIG. 10 is an exploded view of the prior art.

Referring to FIGS. 6-9, the first handle 1 has a first curved surface 14 and a first limiting surface 15 defined around an outer periphery thereof. The second handle 2 has a second curved surface 25 and a second limiting surface 26 defined around an outer periphery thereof. The sleeve 3 has an inner surface 31 defined around therein. The inner surface 31 of the sleeve 3 has an inner curved surface 32 and an inner limiting surface 33 defined thereon. The inner curved surface 32 of the sleeve 3 is slidable between the first curved surface 14 of the first handle 1 and the second curved surface 25 of the second handle 2. The inner limiting surface 33 of the sleeve 3 is slidable between the first limiting surface 15 of the first handle 1 and the second limiting surface 26 of the second handle 2. A lock mode of the present invention is defined as the inner limiting surface 33 of the sleeve 3 is sliding between the first limiting surface 15 of the first handle 1 and the second limiting surface 26 of the second handle 2. The first handle 1 cannot rotate relative to the second handle 2 when the present invention is in the lock mode, so that the first handle 1, the second handle 2 and the sleeve 3 forms a temporary united structure of the present invention as shown in FIGS. 4 and 6. Therefore, the sleeve 3 prevents the first handle 1 from rotating relative to the second handle 2 when the user is using the present invention, so that the user operates the present invention smoothly. On the contrary, when the sleeve 3 is moved upwardly toward the driving head 12 so as to separate the inner limiting surface 33 of the sleeve 3 from the second limiting surface 26 of the second handle 2, the first handle 1 can axially rotate relative to the second handle 2 as shown in FIGS. 5 and 7, so that the user can adjust the operational angle and the operational position of the present invention.

Although the invention has been explained in relation to its preferred embodiment, it is to be understood that many other possible modifications and variations can be made without departing from the spirit and scope of the invention as hereinafter claimed.

What is claimed is:

1. A wrench device comprising a first handle and a second handle;

the first handle having a pivotal connecting segment defined at one end thereof, a driving head disposed at another end thereof, wherein the driving head being driven bi-directional and having two functional parts, the pivotal connecting segment being a cylinder shaped segment and having a groove defined around in an outer periphery thereof, first handle having a first curved surface and a first limiting surface respectively defined in an outer periphery thereof;

the second handle having a pivotal connecting recess defined at one end thereof, and a driving part defined at another end thereof, the pivotal connecting segment of the first handle pivotally inserted into the pivotal connecting recess of the second handle so that the first handle is axially rotatable relative to the second handle about the longitudinal axis of the cylinder shaped segment, a side screwed hole opened on a surface therethrough, the side screwed hole communicating with the pivotal connecting recess and corresponding to the groove of the first handle, a position member screwed into the side screwed hole, one end of the position member positioned in the groove of the first handle, the second handle having a second curved surface and a second limiting surface respectively defined in an outer periphery thereof, and a sleeve slidably sleeving on the first handle and slidable between the first handle and a connecting portion of the first handle and the second handle, the first handle being not rotatable relative to the second handle when the sleeve is positioned at the connecting portion of the first handle and the second handle, the sleeve having an inner surface defined in an inner periphery thereof, the inner surface of the sleeve having an inner curved surface and an inner limiting surface defined thereon, the inner curved surface of the sleeve being slidable on the first curved surface of the first handle, or slidable on a portion of the first curved surface of the first handle and the second curved surface of the second handle, the inner limiting surface of the sleeve being slidable on the first limiting surface of the first handle, or slidable on a portion of the first limiting surface of the first handle and the second limiting surface of the second handle.

2. The wrench device as claimed in claim 1, wherein the driving part of the second handle is an open-end wrench.

* * * * *